United States Patent [19]

Wagaman et al.

[11] Patent Number: 4,940,416

[45] Date of Patent: Jul. 10, 1990

[54] PRESSURE COMPENSATING CONNECTOR ASSEMBLY

[76] Inventors: James P. Wagaman; Neil B. Karlskind, both of 9450 Cozycroft Ave., Chatsworth, Calif. 91311

[21] Appl. No.: 367,419

[22] Filed: Jun. 16, 1989

[51] Int. Cl.[5] ..... H01R 13/523

[52] U.S. Cl. ..... 439/204; 439/199; 439/206; 439/271

[58] Field of Search ..... 439/199, 201, 204, 206, 439/271, 275, 276, 205

[56] References Cited

U.S. PATENT DOCUMENTS

| | | | |
|---|---|---|---|
| 3,633,155 | 1/1972 | Taylor | 439/204 |
| 4,373,767 | 2/1983 | Cairns | 439/199 X |
| 4,500,155 | 2/1985 | Chevalier | 439/275 |
| 4,606,603 | 8/1986 | Cairns | 439/206 X |
| 4,907,980 | 3/1990 | Wagaman et al. | 439/204 |

*Primary Examiner*—Steven C. Bishop

*Attorney, Agent, or Firm*—Nilsson, Robbins, Dalgarn, Berliner, Carson & Wurst

[57] ABSTRACT

A connector for use in deep ocean, high temperature and other high pressure environments has a housing defining an interior chamber filled with non-electrically conducting fluid wherein the cable termination is interconnected to a male or female contact apparatus. A pressure equalizing apparatus according to the invention includes a cylindrical sealing sleeve positioned adjacent to the interior of the chamber. The apparatus also includes a pair of mating sleeves positioned in the interior chamber, in spaced apart relationships, each having a cylindrical mating surface which sealingly mates against the interior surface of the sealing sleeve and a projecting sleeve receiving cylindrical surface. The sleeve receiving surfaces are juxtaposed opposite one another. An elastomeric boot is positioned over the sleeve receiving surfaces of each mating sleeve to thereby extend between the pair of sleeves and divide the interior chamber into an interior non-electrically conducting fluid retaining region and an exterior region. An orifice is provided through the connector housing and the sealing sleeve to provide communication between the exterior region adjacent the elastomeric boot and the environment outside the connector.

2 Claims, 2 Drawing Sheets

PRESSURE COMPENSATING CONNECTOR ASSEMBLY

BACKGROUND OF THE INVENTION

The present invention relates to undersea and other high temperature and high pressure environment connectors and specifically to apparatus for equalizing the pressure between an interior chamber of the connector and the outside environment in which the connector is placed.

The inaccessibility and expense of changing or repairing deep ocean or down-hole pump electrical connectors has mandated that such connectors be extremely reliable even though operating in a hostile environment with cathodic corrosive effects and extreme pressures.

Connectors used in high temperature or high pressure environments often include an interior closed chamber filled with non-conductive fluid wherein connection of individual wires in a cable are made either to a male or female connector insert. The connector end of the insert extends from the interior chamber of the connector assembly and is available for connection to a cooperating connector assembly. It is recognized that if the pressure in the interior chamber fluid is equalized with the pressure of the environment in which the connector is placed, the chances of failure of the connector due to pressure differentials will be greatly reduced.

Heretofore, various mechanisms have been used to achieve such pressure equalization. For example, in some connectors the interior chamber is pre-pressurized to a pressure which approximates the pressure of the environment in which the connector will actually be used. However, large pressure differentials will still exist when the connector is not in its operating environment such as before installation. Plungers and various other complex mechanical mechanisms have also been used to enable pressure of the interior chamber to be continuously-varied to match the external pressure of the environment. However, the complexity and expense of such mechanisms have limited their applicability to only the largest connector assemblies and even then only where the added expense could be justified. Consequently pressure equalization mechanisms for small sized, deep ocean connectors or less expensive connectors have not heretofore been possible.

Previous connectors solved this problem by providing a pressure compensation mechanism for use particularly in deep sea or down-hole pump connector assemblies which allow the interior chamber of the connector to always be at the same pressure as the external environment while still maintaining the integrity of the non-electrically conducting fluid in the interior of the chamber. Previous apparatus achieved this result through the use of an elastomeric boot stretched clamped between two mating sleeves and the interior housing surface of the chamber. The elastomeric boot was used to divide the chamber into an interior region inside the boot and an exterior region radially between the boot and the interior housing surface of the chamber. The chamber housing was then provided with a pressure equalizing orifice whereby the environment outside the chamber housing communicated with the pressure compensation mechanism so that the incompressible fluid confined in the interior region of the chamber will be at the same pressure as the environment outside the connector.

However, the use of an elastomeric boot made insertion of the boot into the chamber interior difficult because the boot would catch on the chamber interior creating an incomplete seal between the interior of the chamber and the mating sleeves, thus allowing fluids from the environment outside the connector to enter into the interior region inside the boot. Further, over time the elastomeric boot would deteriorate causing the boot material to stick to the interior region of the chamber. This made removal of the boot difficult. Additionally, in previous pressure compensation mechanisms the boot was bonded to the mating sleeves with an adhesive. This requirement limited the available materials for the boot and the mating sleeves to materials capable of being bonded with a corrosive resistant adhesive.

The present invention solves these problems by providing a perforated sealing sleeve inserted between the interior chamber housing and the elastomeric boot. The perforated sealing sleeve maintains a slight radially directed compression force on the boot, thus sealing the boot to the mating sleeves without the use of an adhesive. This allows the boot and the mating sleeves to be made with exotic materials capable of withstanding highly corrosive environments. The perforated sealing sleeve also provides for convenient assembly and disassembly of the connector because the smooth surface of the sealing sleeve slides easily into and out of the interior of the chamber housing.

SUMMARY OF THE INVENTION

The present invention comprises a pressure compensating connector for high pressure and highly corrosive environments. The connector includes a first assembly coupled to the end of a first cable which has at least one first wire and a second assembly coupled to a second cable which also has at least one second wire. The second assembly is configured to mate with the first assembly to thereby connect the first cable to the second cable. The first and second assemblies each have a front shell with an axially disposed front shell interior surface in which a circumferentially disposed front shell interior surface groove is disposed, and an axially disposed front shell exterior surface with a circumferentially disposed front shell exterior surface groove therein. A feed-through insert is positioned in the front shell. The feed-through insert has a cable facing end for receiving the cable, a wire facing end opposite the cable facing end through which the individual wires of the cable protrude, and a radially disposed feed-through insert abutment flange. A retaining means extends radially from the front shell interior surface groove to define a radially extending retainer abutment shoulder. A front tube spacer is positioned with its rear end in abutting relationship against the retainer abutment shoulder and its front end in abutting relationship against the feed-through insert abutment flange so that the feed-through insert is axially aligned and retained in the front shell. Each assembly also includes a housing which has a housing interior surface, a rear region, a circumferential housing interior thread at the rear region and a front region. The front region is positioned in sealed relationship over the front shell exterior surface with the front region also having a circumferentially disposed housing exterior thread. A first interconnect means is positioned between the housing interior surface and the front shell exterior surface for interconnecting the housing and the front shell in axially and rotationally immoveable relationship. A housing end nut is positioned over the interconnect means. The housing end nut has an interior radially disposed nut abutment shoulder for abutment against the interconnect means and a circumferential nut interior thread for threading onto the housing exterior thread for retaining the housing on the front shell exterior surface. A rear shell is then provided with a rear shell outside surface, a front facing, radially extending rear shell abutment shoulder and a rear shell front end with a shell interior thread therein. A contact insert for positioning in the rear shell includes a contact front end for receiving the ends of the wires, a contact rear end with at least one mating contact, a rear facing radially disposed contact insert abutment flange for abutting against the rear shell abutment shoulder, and a front facing radially disposed contact insert abutment shoulder. A rear tube spacer is positioned in the rear shell has a first end in abutting relationship against the contact insert abutment shoulder. A spacer tube retaining nut is threaded into the shell interior thread so that one of its ends abuts against the second end of the rear tube spacer for causing the contact insert abutment flange to be pressed into contact against the rear shell abutment shoulder for axially positioning and retaining the contact insert in the rear shell. A second interconnect means is then positioned between the rear shell outside surface and the housing interior surface for interconnecting the housing and the rear shell in axially and rotationally immoveable relationship. A housing retaining nut with a nut exterior thread is then screwed into the housing interior thread to retain the housing on the rear shell.

The first assembly further includes an engaging nut on the first assembly rear shell axially adjacent the housing retaining nut in rotationally moveable but axially retained relationship on the rear shell.

The rear shell of the second assembly further has an outside threaded engaging end, the engaging nut engaging with the outside threaded engaging end for coupling the first and second assemblies together whereby the mating contacts of the first and second assemblies are coupled together for electrically coupling the first and second cables.

Each assembly also defines a pressure compensation apparatus in the interior of its housing a chamber in which a substantially incompressible, non-electrically conducting fluid resides. The pressure compensation apparatus includes a circumferential, perforated sealing sleeve located adjacent to the circumferential interior surface of the chamber. In the preferred embodiment, the perforated sealing sleeve is made of a rigid, corrosive resistant material, such as a corrosive resistant metal, plastic or other suitable material. The apparatus also includes a first cylindrical mating sleeve positioned in the chamber where the first mating sleeve has a first surface which is configured to be in sealing contact against the circumferential interior surface of the chamber. The first mating sleeve further includes a second surface which is spaced radially inwardly from the circumferential interior surface of the chamber for providing a space between the second surface and the interior surface of the chamber. The second surface has on its remote end a first circumferential locator nib which protrudes radially toward the circumferential interior surface of the chamber but remains spaced from that surface.

A second cylindrical mating sleeve is similarly positioned in the connector chamber but in spaced relationship to the first mating sleeve. The second mating sleeve likewise has a third surface which, like the first surface on the first mating sleeve, provides a sealing contact against the circumferential interior surface of the chamber. The second mating sleeve also has a fourth surface which is spaced inwardly from the circumferential surface of the chamber thereby providing a space between the fourth surface and the circumferential interior surface of the chamber. The fourth surface also has a locator nib which protrudes radially therefrom in a direction toward the circumferential surface of the chamber but is radially spaced therefrom. An elastomeric boot is positioned to extend between the first and second mating sleeves whereby the elastomeric boot has a first end sized for being stretched fitted over the second surface of the first mating sleeve and having a second end which is sized to be stretched fitted over the fourth surface of the second mating sleeve thereby bifurcating the chamber into an interior region inside the boot and an exterior region radially between the boot and the surface of the chamber. The exterior region extends longitudinally between the first surface of the first mating sleeve and the third surface of the second mating sleeve. Positioned circumferentially around the boot between the interior of the chamber and the exterior surface of the boot is a perforated sealing sleeve which extends between the facing surfaces of the first and second mating sleeves. The perforated sealing sleeve has at least one orifice therethrough to provide communication between outside environment of the connector and the exterior region inside the boot. The housing is then provided with a pressure equalizing orifice therethrough at a location whereby the exterior region of the chamber communicates through the orifices in the perforated sealing sleeve with the environment outside the connector so that the incompressible fluid confined in the interior region of the chamber will be at the same pressure as the environment outside the connector.

BRIEF DESCRIPTION OF THE DRAWINGS

These and other advantages and features of the invention will be more fully apparent from the detailed description below taken with the accompanying drawings in which like reference characters refer to like parts throughout and wherein.

DETAILED DESCRIPTION

Figure 1:
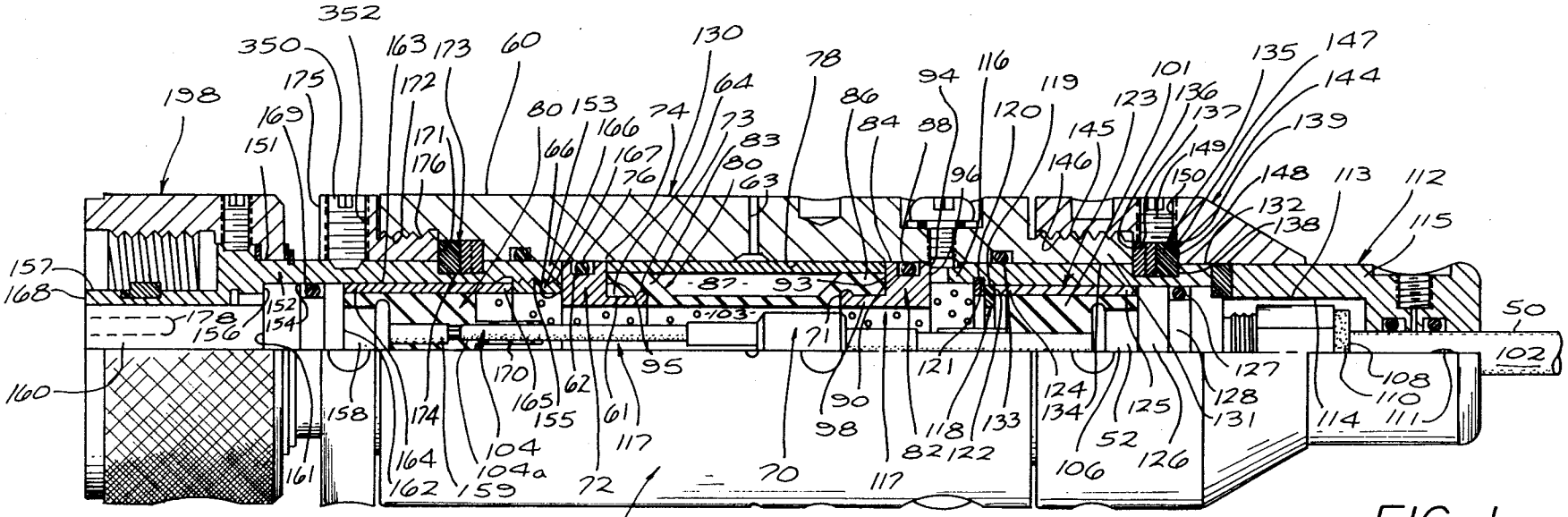
FIG. 1 is a side, partial cut away view of a connector half attached to one cable in accordance with the invention.
Figure 2:
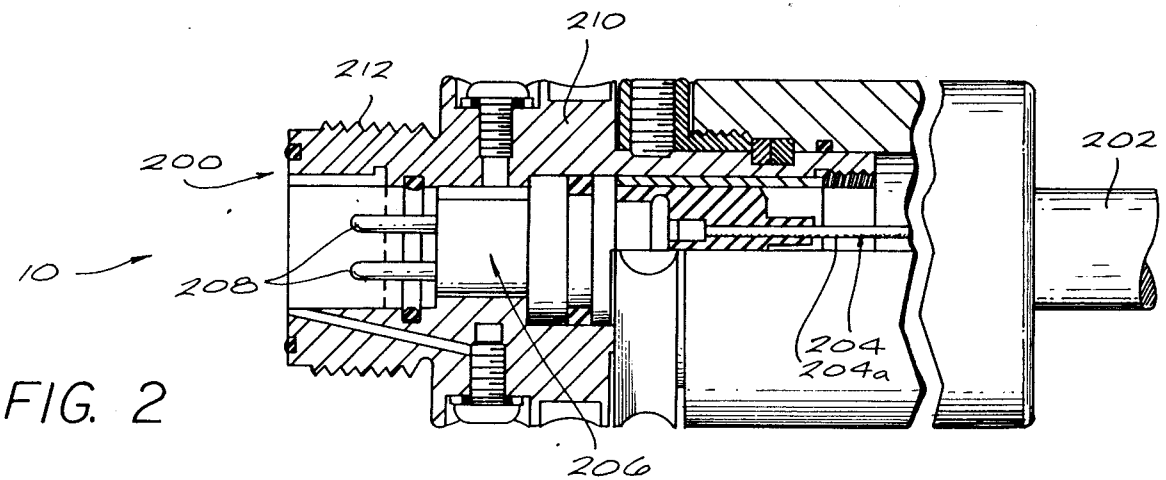
FIG. 2 is a truncated cut away view of the other half of the connector attached to a second cable in accordance with the invention.
Figure 3:
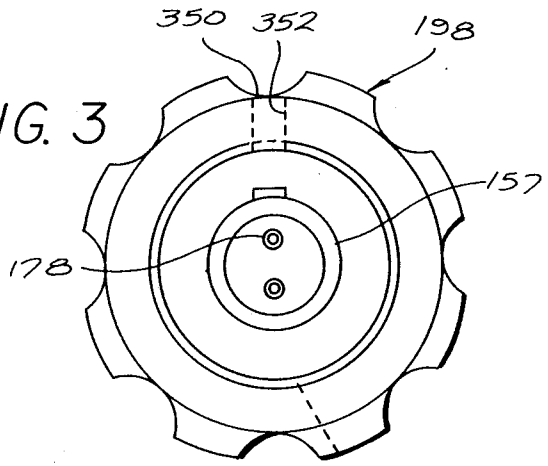
FIG. 3 is an end view of an engaging nut for interconnecting the two halves of the connector illustrated in FIGS. 1 and 2.

Referring to FIGS. 1, 2 and 3, a connector 10 includes a first assembly (connector half) 100 and a second assembly (connector half) 200 configured for being joined together by an engaging nut 198. In the illustrated embodiment, the first assembly 100 is the female part of the connector and the second assembly 200 is the male part of the connector. Except for their respective mating ends, the first assembly 100 and second assembly 200 have substantially identical configurations. Accordingly, only the configuration of the first assembly 100 will be described in detail. The first assembly 100 is coupled to the end of a first cable 102 while the second assembly 200 is coupled to the end of a second cable 202. The first cable 102 encases and surrounds a first set of wires 104 which includes at least one wire 104a, while the second cable 202 encases and surrounds a second set of wires 204 which includes at least on second wire 204a. In the usual arrangement, both the first cable 102 and the second cable 202 will each have a plurality of first and second wires interconnected to one another in a predefined arrangement when the first assembly 100 and the second assembly 200 are joined and locked together by the coupling nut 198.

Turning more specifically to FIG. 1, the end of the first cable is stripped to expose extended lengths of the first wires 104. The exposed lengths of the wires 104 are inserted through a feed-through insert 106 which has a wire facing end 52 and a cable facing end 108. The cable facing end 108 is attached to a outside casing 50 of the first cable 102 using a suitable potting gasket 110 and securing polyester resin 111. The feed-through insert 106 is positioned inside a front shell 112 having a front shell interior surface 114, a front end 115 and a rear end 116. The feed-through insert 106 is secured against movement relative to the front shell 112 using a suitable wedge potting 113 wedged between the front shell interior surface 114 and the outside surface (casing) 50 of the first cable 102. The front shell front end 115 is juxtaposed radially adjacent the first cable 102 and the front shell rear end 116 is juxtaposed radially adjacent an interior cavity 117 defined by the first assembly 100.

A retaining means 118 is disposed circumferentially around and extending from the front shell interior surface 114 near the front shell rear end 116 to provide a inwardly projecting radially disposed retainer abutment shoulder 122. In one embodiment, the retaining means 118 includes a retaining washer 119 and a retaining ring 120 positioned rearwardly of the retaining washer 119 in a front shell interior surface groove 121. The retaining washer 119 projects radially into the interior cavity 117 from the front shell interior surface 114 to define the retainer abutment shoulder 122.

A front spacer, such a the front tube spacer 123, is positioned inside the front shell 112 adjacent the front shell interior surface 114. The front tube spacer 123 has a spacer rear end 124 and a spacer front end 125 with the spacer rear end 124 positioned in abutting relationship against the retainer abutment shoulder 122. The feed-through insert 106 has a radially disposed, outwardly extending, feed-through insert abutment flange 126 which abuts against the spacer front end 125 so that the front tube spacer 123 will prevent rearward axial movement of the feed-through insert 106 relative to the front shell 112.

In order to provide sealing between the interior 117 of the first assembly 100 and the outside environment, an O-ring seal 127 is positioned in circumferential groove 128 about the periphery of the feed-through insert 106 so as to press against the front shell interior surface 114. A feed-through insert boot 101 made of a suitable elastomeric material is also stretch fitted both over the wire facing end 52 of the feed-through insert 106 and over each of the wires 104 to form a seal between the surface of the wires and the boot and between the surface of the feed-through insert and the boot.

The housing 130 has a rear region 60 and a front region 131 which is slidingly positioned over the front shell exterior surface 132 at the rear end of the front shell 116. The housing 130 has a housing interior surface 134 which is generally in contact with the front shell exterior surface 132. An 0-ring seal 133 is then positioned in a circumferential groove to form a seal between the housing interior surface 134 and the front shell exterior surface 132.

Axial positioning and alignment of the housing 130 relative to the front shell 112 is accomplished by a first interconnect means 135. The first interconnect means 135 provides an outwardly extending radial first interconnect shoulder 136. The housing 130 is configured to define a front end abutment surface 137. The front end abutment surface 137 is positioned to abut against the first interconnect shoulder 136 to limit forward movement of the housing 130 relative to the front shell 112.

Prevention of rotational movement between the housing 130 and the front shell 112 is also desired. Therefore, the first interconnect means 135 is also configured to prevent such relative rotational movement. Such an arrangement may be provided by a pin-split ring arrangement wherein the front shell exterior surface 132 of the front shell 112 is provided with a front shell exterior surface groove 138. A split ring 139 is then positioned in the groove 138 to provide the first interconnect shoulder 136 against which the front end abutment surface 138 abuts. To prevent rotational movement, the split ring 139 has a radially disposed cylindrical half orifice 140 (FIG. 4) and the front end abutment surface 137 has a mating radially disposed half orifice 142 configured to be aligned with an orifice 141 disposed in the bottom of the groove 138 of the front shell. To join the housing 130 in axial and rotationally immoveable relationship to the front shell 112, the split ring 139 is positioned in the front exterior surface groove 138 and the front end abutment surface 137 is abutted against the first interconnect shoulder 136 provided by the rear facing radial side of the split ring 139. The orifices 140 and 142 are then aligned with each other and radially juxtaposed over the orifice 141. A suitable dowel pin 143 is then inserted through the orifice defined by the half orifices 140 and 142 into engagement in the orifice 141. So long as the front end abutment surface 137 of the housing 130 remains in abutting relationship against the first interconnect shoulder 136 with the pin 143 positioned in the groove 141, rotational and axial movement between the housing 130 and the front shell 112 will be prevented.

To ensure retention of the housing 130 in abutting relationship against the split ring 139, a housing end nut 144 having a nut interior thread 145 is slidingly positioned over the front shell exterior surface 132. The housing 130 further has a housing exterior thread 146 extending rearwardly from the front end abutment surface 137 for being engaged by the nut interior thread 145. The housing end nut 144 further has a radially extending nut abutment shoulder 147 spaced forward of the nut interior thread 145 for engagement against a radially projecting front edge 148 of the interconnect means 135. Accordingly, when the housing end nut 144 is fully engaged on the housing 130 with the housing exterior thread 146 and the nut interior thread 145 fully mated, the nut abutment shoulder 147 will press against the front edge 148 of the interconnect means 135 with the front end abutment surface 137 of the housing 130 pulled into pressing relationship against the first interconnect shoulder 136 to thereby retain the split ring 139 and dowel pin 143 in proper position to prevent both radial and axial relative movement between the housing 130 and the front shell 112. Finally, a suitable set screw 149 is screwed into a threaded orifice 150 through the housing end nut 144 to prevent the housing end nut from loosening once the fully engaged arrangement described above has been achieved.

The first assembly 100 further includes a rear shell 152 having a rear shell front end 153, a rear shell rear end 157 opposite the front end 153, a rear shell outside surface 151 and a rear shell interior surface 154. A shell interior thread 155 is provided in the rear shell interior surface 154 at the front end 153. A radially disposed front facing rear shell abutment shoulder 156 is provided along the rear shell interior surface 154 at a central location between the rear shell front end 153 and the rear shell rear end 157.

In accordance with the invention, the wires 104 extend through the interior cavity 117, which is preferably filled with a dielectric fluid 103, to a contact insert 158 disposed interiorly of the rear shell 152 where the wires 104 are appropriately coupled to the individual cavity facing contacts of the contact insert 158. The contact insert 158 has a contact front end 159 at which the wires 104 are attached, and a contact rear end 160 opposite the contact front end 159. The contact insert 158 further has a radially extending rear facing contact insert abutment flange 161 and a front facing contact insert abutment shoulder 162. The contact insert 158 is slidingly inserted into the rear shell 152 until the contact insert abutment flange 161 contacts and abuts against rear shell abutment shoulder 156 to prevent further rearward axial movement of the contact insert 158 relative to the rear shell 152. A rear spacer such as rear tube spacer 163 having a first end 164 and a second end 165, is inserted into the rear shell 152 so as to be adjacent the rear shell interior surface 154. The rear tube spacer 163 is inserted until first end 164 presses against the contact insert abutment shoulder 162. A spacer tube retaining nut 166 with an exterior thread 167 is then screwed into the rear shell front end 153 in engagement with the shell interior thread 155 to press the second end 165 of the rear tube spacer 163 against the contact insert abutment shoulder 162. Thus, when the spacer tube retaining nut 166 is fully tightened, the rear facing edge of the spacer tube retaining nut 166 will press against the second end 165 of the rear tube spacer 163 to cause the first end 164 of the rear tube spacer 163 to press against the contact insert abutment shoulder 162 which in turn forces the rear contact insert abutment flange 161 to press against the rear shell abutment shoulder 156.

Advantageously, this arrangement eliminates the possibility that tolerances of various dimensions will be additive to such an extent that the connector will be out of specification making complete coupling impossible. Thus, in the present invention, the only dimensions whose tolerances need be of concern are the dimension between the rear shell abutment shoulder 156 and a front edge 168 of the rear shell 152 and the dimension between the rear shell abutment shoulder 156 and a front end 54 of the contact insert 158. In prior art devices instead of two dimensions, there were as many as eight dimensions whose tolerances could become additive.

To provide sealing, a suitable O-ring 169 is positioned in a groove in the contact insert to press against the rear shell interior surface 154. A contact boot 170 is provided over the wires 104 and the contact front end 159 in a manner similar to that previously described in conjunction with the feed-through boot 128.

Figure 4:
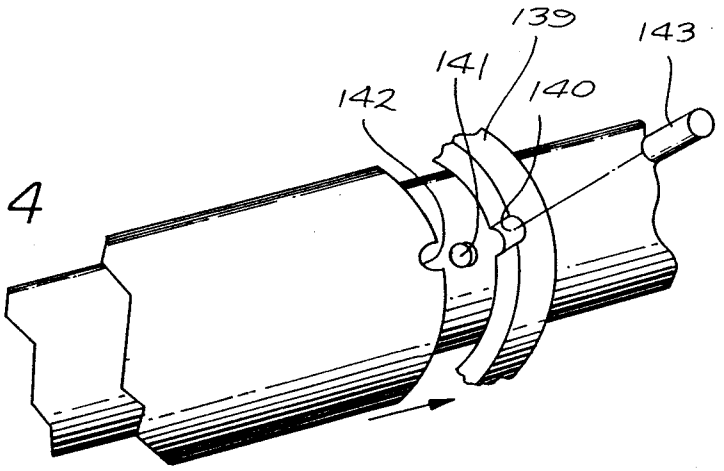
FIG. 4 is a pictorial detail illustrating one embodiment of an interconnect means for preventing axial and rotational movement between the housing and the shell of the connector in accordance with the invention.

The housing 130 further has the rear region 60 which has a housing interior thread 172. In order to prevent axial and rotational movement between the housing 130 and the rear shell 152, a second interconnect means 173 substantially the same as the first interconnect means 135 is provided in a suitable groove 174 in the rear shell outside surface 153. A housing retaining nut 175 having a retaining nut front end 171 with a nut exterior thread 176 is then screwed into engagement with the housing interior thread 172 to come into contact with the second interconnect means 173 to thereby hold the rear shell and housing in axially and rotationally immovable relationship relative to one another in the same manner as previously described in connection with the operation of the first interconnect means 135 as illustrated in FIG. 4.

The contact insert 158 has one or more mating contacts 178 which in the embodiment illustrated are inserts for electrically coupling with the mating second assembly 200. Finally, the engagement nut 198 as illustrated in FIG. 3 is rotationally mounted to the rear end 157 of the rear shell 152 in a conventional manner. To provide attachment, the engaging nut has an engaging nut interior thread 199.

Turning to FIG. 2, a contact insert 206 is provided to receive the various second contact wires 204. Extending from the end of the contact insert 206 are one or more mating contacts 208 comprising electrically conductive pins arranged to mate with the inserts 178 of FIG. 1. The contact insert 206 is inserted and retained within a rear shell 210 in a manner similar to that previously described in connection with FIG. 1. However, instead of an engaging nut 198, the rear shell 210 has an external thread 212 configured to engage with the interior thread of the engaging nut 198.

Once a positive mate has been achieved, an anti-rotation screw 350 may be inserted into a threaded orifice 352 to press against the rear shell 152 and thereby lock the engaging nut 198 against further rotation and hence lock the first assembly into interconnection with the second assembly 200.

When connectors with interior chambers, such as the one depicted in FIG. 1, are used in undersea, high temperature, high pressure or highly corrosive environments, the pressure differential can adversely affect the sealing necessary to maintain maximum integrity of the first assembly 100 and, in particular, to prevent contamination of the dielectric fluid 103 which is placed in the interior cavity 117. Highly corrosive environments also necessitate the use of exotic materials in the construction of the interior chamber. Any salt water invasion or contamination in the interior cavity 117 could result in corrosion of critical electrical components and could cause electrical conduction between individual wires 104 which extend through the interior cavity 117.

Therefore, in accordance with the invention, a pressure compensation apparatus 70 has been incorporated in the housing 130. The pressure compensation apparatus 70, in the illustrated embodiment of the invention, includes a first mating sleeve 82, which is preferably cylindrical, with a first mating surface 84 in sealing contact against a juxtapositioned housing interior surface 78 of the housing 130. To enhance sealing between the first mating surface 84 and the interior cylindrical surface 86, an 0 ring 88 is placed in a circumferential groove 90 in the first mating surface 84 of the first mating sleeve 82. In the preferred embodiment of the invention, longitudinal positioning is maintained by providing a circumferential radially disposed abutting surface 94 in the housing 130. A radially projecting surface 96 of the first mating sleeve 82 is provided to abut against the radial surface 94 in the interior of the housing 130. Axial movement of the first mating sleeve 82 is thereby made impossible.

The first mating sleeve 82 further includes a second surface 98 which is spaced radially inwardly from the housing interior surface 78 of the housing 130 thereby providing a space between the second surface 98 and the housing interior surface 78. In accordance with a preferred embodiment of the invention, the second surface 98 has a circumferential locator nib 71 which protrudes radially from the second surface 98 toward, but still spaced from, the interior housing surface 78 of the housing 130.

In accordance with the invention, a second cylindrical mating sleeve 72 is similarly positioned in the housing 130 but at a location spaced from the first mating sleeve 82. Like the first mating sleeve 82, the second mating sleeve 72 has an axially extending circumferential surface 74 which is in sealing contact against a juxtapositioned portion of the interior housing surface 78 of the housing 130. An appropriate O ring 76 is placed in a circumferential groove 62 to ensure that a seal is made and maintained between the surface 74 and the interior housing surface 78. Like the first mating sleeve 82, the second mating sleeve 72 also has a radially projecting abutment surface 66, perpendicular to the surface 74, for abutment against rear tube spacer 163 and the rear shell front end 153 of the rear shell 152. The abutment between the surfaces 66, 163 and 152 ensures that axial movement of the second mating sleeve 72 will be impossible.

The second mating sleeve 72 further includes a sealing surface 61 which is spaced inwardly from the interior housing surface 78 of the housing 130 to thereby provide a space 64 between the second surface 61 and the interior housing surface 78. In a preferred embodiment of the invention, the sealing surface 61 has a circumferential locator nib 73 which protrudes radially from the sealing surface 61 but which is still spaced from the interior housing surface 78 of the housing 130.

The locator nib 71 is preferably positioned within the first mating sleeve 82 at the end of the second surface 98 remote from the projecting surface 96. Likewise the locator nib 73 of the second mating sleeve 72 is located at the end of the second mating sleeve 72 remote from the abutting surface 66.

An elastomeric boot 80 is provided with a first end 86 sized for being stretched fitted over the sealing surface 98 between the first mating sleeve 32 and the interior housing surface 78 of the housing 130. The elastomeric boot 80 further has a second end 83 which is sized to stretch fit over the second mating sleeve 72 between the sealing surface 61 of the second mating sleeve 72 and the interior housing surface 78 of the housing 130.

Figure 5:
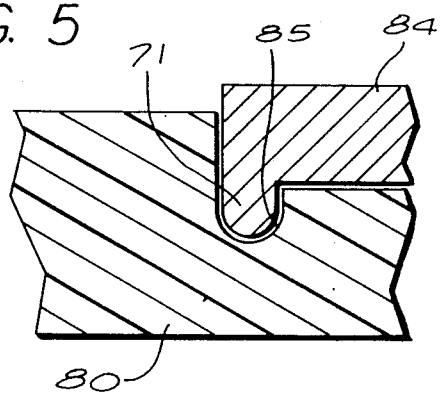
FIG. 5 is a pictorial detail illustrating the right locator nib positioned in a circumferential channel in the elastomeric boot in accordance with the invention.

Referring to FIG. 5, in a preferred embodiment, the boot 80 has an interior disposed circumferential channel 85 which is positioned adjacent to boot 80 but inwardly spaced from each one, one being at a location adapted, for example, to receive the locator nib 71 thereby enabling the boot 80 to be properly positioned over the first and second mating sleeves 82 and 72 respectively. Accordingly, a seal is formed between the second surface 98 and the first end 86 of the boot 80 and between the sealing surface 61 and the second end 83 of the boot 80. The boot 80 thereby divides the pressure compensating apparatus 70 into the interior cavity 117 and a cylindrically-shaped exterior region 87 with the dielectric fluid 103 confined by the boot 80 in the interior cavity 117.

In order to provide pressure compensation, an orifice 63 is provided through the housing 130 in communication between the exterior environment of the connector and the exterior region 87 of the pressure compensating apparatus 70. Since the dielectric fluid 103 in the interior cavity 117 is incompressible, the orifice 63 will permit equalizing pressure communication via the boot 80 so that the pressure in the interior cavity 117 of the pressure compensating apparatus 70 will be the same as the pressure in the exterior region 87 of the pressure compensating apparatus 70. Such pressure equalization enables the connector in accordance with the present invention to eliminate pressure as a cause which would urge fluid from the exterior region 87 outside of the pressure compensating apparatus 70 to communicate with the fluids external to the connector.

In the preferred embodiment, in order to provide a superior seal between the boot 80 and the first and second mating sleeves 82 and 72, respectively, and to allow the boot 80 and the first and second mating sleeves 82 and 72, respectively, to be made with exotic materials, a perforated circumferential sealing sleeve 91 is positioned circumferentially around the boot 80 between the interior housing surface 78 of the housing 130 and the exterior surface of the boot 80. The perforated sealing sleeve 91 extends between a facing surface 93 of the first mating sleeve 82 and a facing surface 95 of the second mating sleeve 72.

Figure 6:
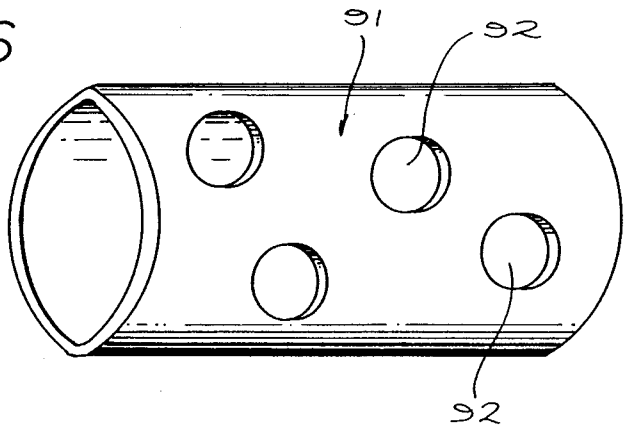
FIG. 6 is a pictorial detail illustrating the perforated sealing sleeve and the pressure equalizing orifices.

The sealing sleeve 91 (FIG. 6) has at least one orifice 92 therethrough to provide communication between the exterior environment of the connector and the exterior region 87 of the pressure compensating apparatus 70. The sealing sleeve 91 provides sufficient radially directed pressure on the boot 80 to ensure that a seal is made between the boot 80 and the first and second mating sleeves 82 and 72, respectively, without the use of adhesives. This allows the boot 80 and the first and second mating sleeves 82 and 72, respectively, to be made with exotic corrosion resistant materials which may not easily bond. Further, the smooth exterior surface of the sealing sleeve 91 allows the pressure compensating apparatus 70 to be easily inserted and removed from the housing 130.

While specific embodiments of the present invention have been described, it will be appreciated that numerous alternations and variations are possible without departing from the invention in its broadest aspects.

What is claimed is:

1. A pressure compensation apparatus for a connector assembly with at least one coupling member comprising a housing with a cable receiving end having a cable receiving orifice therethrough, an interface end with an insert member therein configured to mate with another coupling member, and first means positioned in the cable receiving orifice whereby the cable, comprising at least one wire, extends through the first means, the housing defining a circumferential chamber with a circumferential surface extending between the first means and the insert member, the cable extending through the chamber to couple to the insert member, the chamber having disposed therein a substantially incompressible non-electrically conducting fluid, the pressure compensation apparatus for equalizing the pressure between the inside of the chamber and the outside environment while preventing fluid communication between the chamber and the outside environment comprising:

a cylindrical sealing sleeve positioned in the chamber against the circumferential surface of the chamber;

a first cylindrical mating sleeve positioned in the sealing sleeve and having a first surface for sealing contact against the circumferential surface of the sealing sleeve and a second surface spaced inwardly from the circumferential surface of the sealing sleeve for providing a space between the second surface and the circumferential surface of the sealing sleeve, the second surface having a first circumferential locator nib protruding radially therefrom toward the circumferential surface of the sealing sleeve;

a second cylindrical mating sleeve positioned in the sealing sleeve in spaced relationship to the first mating sleeve, the second mating sleeve having a third surface for sealing contact against the circumferential surface of the sealing sleeve and a fourth surface spaced inwardly from the circumferential surface of the sealing sleeve for providing a space between the fourth surface and the circumferential surface of the sealing sleeve, the fourth surface having a second circumferential locator nib protruding radially therefrom toward the circumferential surface of the sealing sleeve;

an elastomeric boot having a first end sized to stretch fit over the second surface of the first mating sleeve and having a second end sized to stretch fit over the fourth surface of the second mating sleeve to thereby bifurcate the chamber into an interior region inside the boot and an exterior region radially between the boot and the surface of the sealing sleeve and longitudinally between the first surface and the third surface;

the chamber housing having a pressure equalizing orifice therethrough at a location whereby exterior region of the chamber communicates with the environment outside the connector, the incompressible fluid being confined to the interior region of the chamber;

the sealing sleeve having a pressure equalizing orifice therethrough at a location whereby the exterior region of the chamber communicates with the environment outside the connector, the incompressible fluid being confined to the interior region of the chamber.

2. The pressure compensation apparatus of claim 1 wherein the elastomeric boot defines an interior surface with a first circumferential channel therein adjacent to but spaced from the first end and a second circumferential channel therein adjacent to but spaced from the second end, the first channel configured to receive the first locator nib and the second channel configured to receive the second locator nib.

* * * * *